US009896317B2

(12) United States Patent
Bell

(10) Patent No.: US 9,896,317 B2
(45) Date of Patent: Feb. 20, 2018

(54) LABORATORY TEST TUBE HANDLING DEVICE

(71) Applicant: John Kenneth Alexander Bell, Beverly, MA (US)

(72) Inventor: John Kenneth Alexander Bell, Beverly, MA (US)

( * ) Notice: Subject to any disclaimer, the term of this patent is extended or adjusted under 35 U.S.C. 154(b) by 405 days.

(21) Appl. No.: 14/749,005

(22) Filed: Jun. 24, 2015

(65) Prior Publication Data

US 2016/0376137 A1 Dec. 29, 2016

(51) Int. Cl.

| | |
|---|---|
| ***B67B 7/02*** | (2006.01) |
| ***B67B 1/04*** | (2006.01) |
| ***B01L 9/06*** | (2006.01) |
| *B67B 3/14* | (2006.01) |

(52) U.S. Cl.

CPC ..... *B67B 7/02* (2013.01); *B01L 9/06* (2013.01); *B67B 1/045* (2013.01); *B01L 2200/025* (2013.01); *B01L 2300/043* (2013.01); *B67B 3/14* (2013.01)

(58) Field of Classification Search

CPC .... B67B 7/00; B67B 7/02; B67B 7/12; B67B 7/16; B67B 1/045; B67B 1/04; B01L 9/06; B01L 2200/025

See application file for complete search history.

(56) References Cited

U.S. PATENT DOCUMENTS

| | | | | |
|---|---|---|---|---|
| 4,982,553 | A * | 1/1991 | Itoh | B67B 7/02 198/346.2 |
| 5,429,022 | A * | 7/1995 | Nakayama | B67B 7/00 83/152 |
| 6,001,310 | A * | 12/1999 | Shaffer | B01L 3/5021 422/548 |
| 7,159,489 | B2 * | 1/2007 | Itoh | B67B 7/00 53/381.4 |
| 9,038,503 | B2 * | 5/2015 | Bartholomew | B01L 3/50853 81/3.09 |
| 9,199,755 | B1 * | 12/2015 | Cohen | B65B 69/00 |
| 2014/0124510 | A1 * | 5/2014 | Bernay | B01L 3/50853 220/523 |
| 2014/0256058 | A1 * | 9/2014 | Dobrowolski | B01L 3/5082 436/174 |

FOREIGN PATENT DOCUMENTS

| | | | | |
|---|---|---|---|---|
| EP | 0268348 | A2 * | 5/1988 | B67B 7/16 |

* cited by examiner

*Primary Examiner* — Christopher Harmon
(74) *Attorney, Agent, or Firm* — Kajane McManus

(57) ABSTRACT

The present application is directed towards the handling of laboratory test tubes. More particularly to a specialized laboratory device that enables manual opening, closing and capping of multiple test tubes with integral sealing caps. The Laboratory Test Tube Handling Device permits the user to perform multiple processes simultaneously more efficiently and rapidly than current practice.

20 Claims, 5 Drawing Sheets

LABORATORY TEST TUBE HANDLING DEVICE

FIELD OF INVENTION

The present application is directed towards the handling of laboratory test tubes. More particularly to a specialized laboratory device that enables manual opening, closing and capping of multiple test tubes with integral sealing caps. The Laboratory Test Tube Handling Device permits the user to perform multiple processes simultaneously more efficiently and rapidly than current practice.

BACKGROUND OF INVENTION

With the lid assembly in the lifted position and sliding plate retracted, test tubes to be used, up to the maximum quantity available on the rack, are inserted into the rack with the sealing caps closed. The Rack alignment features require that the tubes be inserted with the cap hinges to the back, the cap locking pins to the front. The Lid Assembly is lowered and the sliding plate is moved into the caps to engage the pins on all inserted test tubes simultaneously. The lid assembly hinge is located on an axis coincident with the axis of rotation of the test tube caps allowing all caps to be raised and held open simultaneously while maintaining the test tubes in the rack. When needed, all the test tubes are closed and sealed by lowering the lid assembly. The sliding plate is retracted and the lid assembly is lifted to expose the sealed test tubes. The rack provides access to the necks of the test tubes for marking or labeling as required on the individual test tubes. An open lever is provided to reduce the effort required to lift the Lid Assembly to unseal and open the test tube caps, and for ease of operation uses a downward motion. It pushes the lid assembly up by means of a rod at each end. An extract lever is provided to remove the sealed test tubes out of the rack, after the lid assembly with the sliding plate retracted is in the lifted position, also using a downward motion. A removable magnetic strip runs along the back of, and is in contact with, the test tubes should magnetic separation of the test samples be desired. All materials used in the construction of the Rack are capable of withstanding the temperatures of an autoclave when used for cleaning or sterilization.

These and other aspects, features and advantages of the present invention will become more readily apparent from the attached drawings and the detailed description of the preferred embodiments which follow.

SUMMARY OF INVENTION

The present disclosure provides a device that permits handling multiple test tubes simultaneously for opening, collecting, and capping of test tubes. Laboratory test tubes with integral snap-type sealing caps must be individually handled for opening, filling or emptying and closing. An apparatus is proposed enabling multiple test tubes to be located, opened, held open for filling or emptying, and closed to seal simultaneously.

The Laboratory Test Tube Handling Device is configured to be manually operated permitting a user to quickly and efficiently collect samples and seal multiple tubes simultaneously. The Laboratory Test Tube Handling Device is configured with a top plane that is used with a color scheme for identifying when the cover is in the open position, corresponding to green and a red color indicating when the device is in the locked position. Numerous receptacle devices are placed in a sequential order whereby samplings can take place. Once the desired sampling takes place simultaneous sealing of numerous receptacle devices can take place by manually moving the top plain and sliding it into the locked position. The advantage of using such a device is that it is manually operated and allows the user to reduce effort and quickly perform a desired sampling and obtain results that normally would take considerable time to achieve. The Laboratory Test Tube Handling Device is configured with lifting devices to assist in simultaneously performing operations.

There is a need in the field for a device that allows a user to quickly and efficiently perform multiple sampling manually. Including the ability to simultaneously open and close the sampling receptacles.

Further features and embodiments will become apparent from the description and the accompanying drawings and the detailed description of the preferred embodiments which follow.

BRIEF DESCRIPTION OF DRAWINGS

The preferred embodiments of the invention will hereinafter be described in conjunction with the appended drawings provided to illustrate and not to limit the invention, in which.

Figure 1:
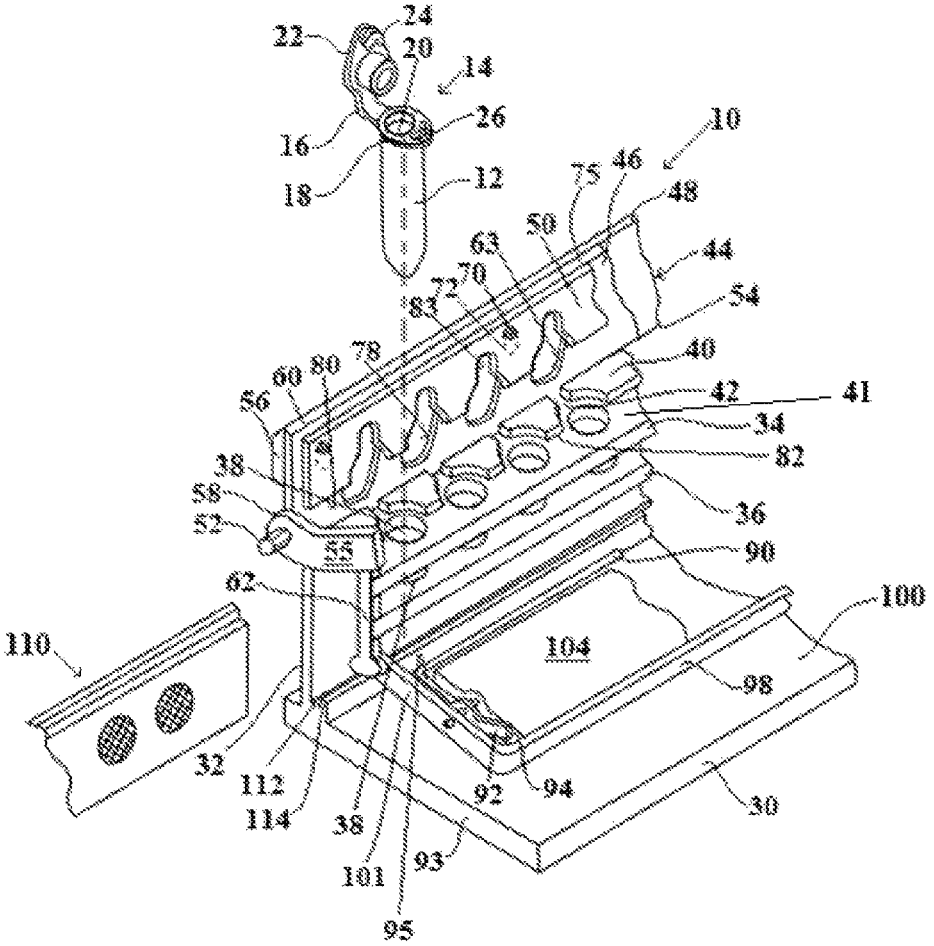
FIG. 1 presents an isometric view of an exemplary Laboratory Test Tube Handling Device.

While the various features of this invention are hereinafter described and illustrated as being particularly adapted for providing rigidity to instrument devices the invention is not limited to the embodiments illustrated in the drawings but are merely used to illustrate the wide variety of uses of this invention. Therefore, the foregoing is considered as illustrative only of the principles of the invention. Since numerous modification and changes will readily occur by those skilled in the art, it is not desired to limit the invention to the exact construction and operation shown and described and accordingly, all suitable modifications and equivalents may be resorted to, falling within the scope of the invention.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to the drawings in greater detail, the assembly for opening multiple capped test tubes simultaneously, hereinafter referred to by reference numeral 10, is sized and configured to open a plurality of test tubes 12, each having a cap 14 thereon which incorporates a hinge 16, such as a living hinge 16 on a collar 18 surrounding a mouth 20 of each test tube 12. From the living hinge 16, extending forwardly, as illustrated, is a cover 22 which includes a latching member or nub 24 which fits into a cooperating opening or lip 26 in the collar 18 to keep the test tubes 12 from accidentally opening.

The assembly 10 thus must accommodate for the hinged cover 22 as well as for the latching member or nub 24 to open test tubes 12 simultaneously. It will be also understood that the assembly 10 can accommodate any plurality of test tubes 12. In a preferred embodiment, 10 to 12 test tubes are accommodated, though this should not be construed as limiting.

The assembly 10 is illustrated to have a base 30 from which a rear wall 32 extends upwardly extending forwardly from the rear wall 32 and supported thereon are two parallel, planar shelves, a top shelf 34 and lower shelf 36, which are vertically spaced apart and each contain aligned openings 38 therein within which the test tubes 12 are received in particular position. In this respect, the openings 38 in the top shelf 34 are each partially surrounded by spaced apart, cooperating positioning rear shoulder pairs 40 upon top surface 41 of top shelf 34 which define an opening 42 therebetween which is configured to receive therein the hinge 16 of each cap 14 to ensure identical alignment to all of the caps 14 relative to a pivotable top 44 which engages over the covers 22 when desired, to simultaneously open a plurality of same.

The pivotable top 44 includes a center planar support 46 sandwiched between upper and lower slidable top and bottom planar members 48 and 50, respectively, the bottom member 50 being used to open the caps 14 when desired. Alternatively, the pivotable top 44 may also be opened while leaving the caps 14 closed, such as for removal of the test tubes 12 from the assembly 10.

The center planar support 46 of the pivotable top 44 extends across a width of the assembly 10 and includes two end pivot nubs 52 toward a rear end edge 54 thereof, the nubs 52 being of any suitable configuration for fixedly engaging a pivot arm 55 and for allowing the top 44 to pivot relative to the test tubes 12 positioned within the assembly 10, as will be defined below. The upper slidable planar member 48 incorporates side flanges 56 alongside edges 58 thereof which extend laterally from the edges 58 toward a forward end edge 60 thereof and overlie upstanding fingers 62 which are used to open the pivotable top 44. There are also provided therein a plurality of cutouts 63 which accommodate receipt of the covers 22 of the test tubes 12 therewithin.

Although shown as 2 separate members in this embodiment, the top and bottom members 48, 50, respectively, could, for example, be formed of a single element curved around the forward end edge 60 of the support 46. Thus, the exemplary embodiment of the assembly 10 should not be construed as limiting as to scope. It will be seen that the top and bottom members 48 and 50 respectively are joined together by suitable engagement members 70, such as bolts 70, which extend through slots 72 provided in the planar support 46 so as to be slidable, together, forwardly and rearwardly along the planar support 46. Further, if desired, indicia 74 (FIG. 2) may be provided on a top surface 75 of planar support 46 which are visible through an opening 76 in top member 48 (FIG. 2), to indicate which position the top and bottom members 48 and 50, respectively, are in, relative to the planar support 46.

The top planar member 48 also serves as a cover 48 for the assembly 10. The bottom planar member 50, on the other hand, is configured for use in opening the covers 22 on the plurality of test tubes 12 within the assembly 10, simultaneously. In this respect, it will be seen that there are specifically configured cutout sections 78 in a rearward end edge 80 of the bottom member 50. It will be understood that the front to rear extent of the bottom member 50 is such that, when the pivotable top 44 is positioned horizontally over the test tubes 12 and pushed rearwardly thereover, they align along forward end edges 82 of the alignment shoulders 40 provided on the top surface 41 of the top shelf 34 holding the test tubes 12 in aligned positioned. A forward end edge 83 of each cutout section 78 includes an undercut area 84 which allows the forward end edge 83 to easily slip between the cap 22 and collar 18 on each test tube 12 to disengage the locking nub 24 by pushing same rearwardly, out of engagement with lip 26 in the collar on each test tube 12 when the bottom member 50 is slid rearwardly on planar support 46. When slid into in this rearward position after being placed into position horizontally over the test tubes 12 and the pivotable top 44 is pivoted to the vertical, the caps 22 on the test tubes 12 are simultaneously opened for access to content within the test tubes 12. This opening, and closing, of multiple test tubes 12 simultaneously saves many man hours of work as compared to the opening and closing of test tubes 12 one at a time, as will be obvious to one skilled in the art.

When closing of the test tubes 12 is desired, such as for removal thereof, it will be understood that the pivotable top 44 is horizontally positioned over the test tubes 12 and the bottom member 50 is manually pushed into the forwardly position along the center support 46 and out of contact with the locking nubs 24, the pivotable top 44 is pushed down against the caps 22, with the locking nub 24 re-engaging into the lip 26 on the collar 18. When the pivotable top 44 is so positioned and now pivoted upwardly, the test tubes 12 are all closed against spillage and easily removable from the assembly 10 through use of a test tube lift narrow, elongate platen 90, to be defined below.

With respect to lifting of the test tubes 12 slightly out of seating within the openings 38 and alignment shoulders 40, a finger pivot 92 is provided along each mirror image end 93 of the base 30 which is manipulated by pushing down on a forward pivot tip 94 which moves a rearward end 95 of the finger pivot 92 upwardly, to which an end of the platen 90 is engaged, the narrow elongate platen 90 extending across a lateral extent of the assembly 10, raising the platen 90 and pushing up on bottom ends 96 of test tubes 12 for ease in grasping of each test tube 12.

Figure 8:
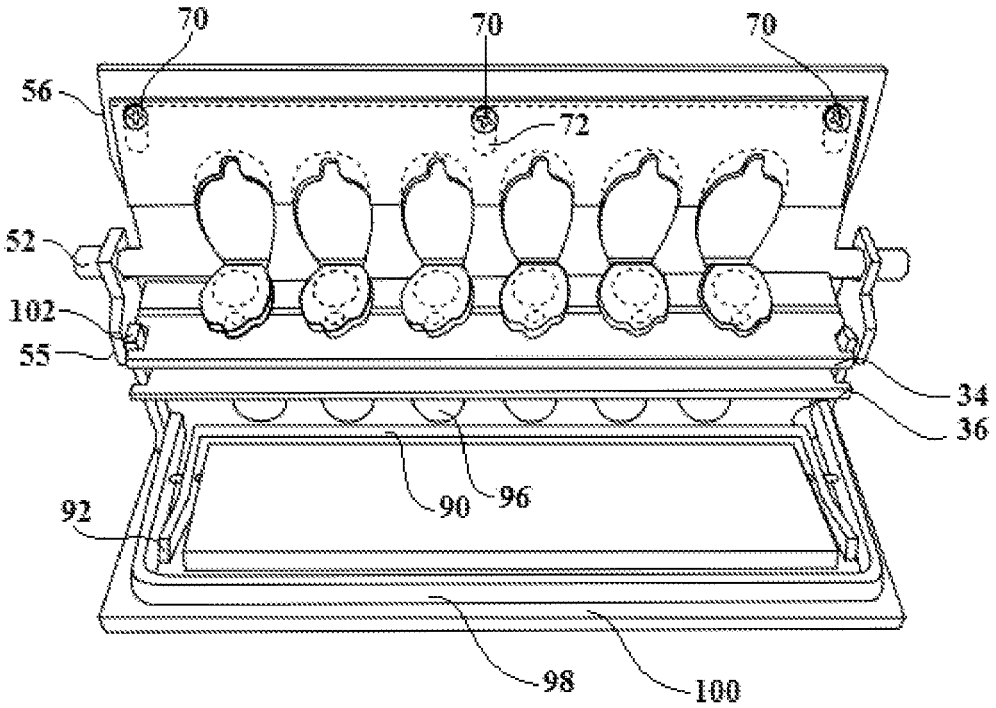
FIG. 8 presents a frontal view of the exemplary Laboratory Test Tube Handling Device in the normal open position.

The pivoting of top 44 from the horizontal to vertical position is accomplished through provision of a pivot rod 98 is provided which extends across the lateral extent of the base 30 along a forward end area 100 thereof as well and when pivoted downwardly causes the upstanding fingers 62 pivotably engaged at each rear end portion 101 of the rod 98 to move upwardly to pivot the pivotable top 44 toward the vertical position thereof. An upper end 102 (FIG. 8) of each finger 62 engages against and pushes up on a corresponding side flange 56 of the pivotable top 44, moving same to a vertical position.

It will be understood that the test tube lift platen 90 and the pivot rod 98 for the top 44 are provided for simplifying operation and are accessory rather than absolutely necessary for function in opening and closing a plurality of test tubes 12 simultaneously as will be understood by those skilled in the art. The assembly 10 could just as easily be operated manually to perform these tasks without undue burden on the user.

It will be seen that, in a preferred embodiment, the pivotable members 90 and 98 are pivotably engaged to an upstanding support 104 for same provided on and raised above the base 30 to allow for pivotability.

Figure 2:
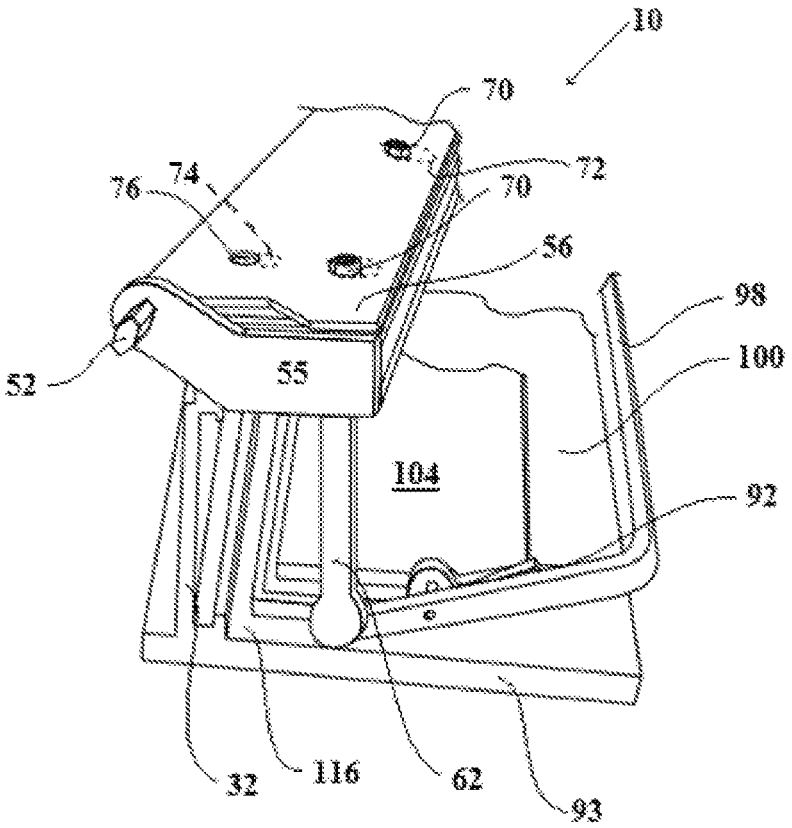
FIG. 2 presents an sectioned Perspective view of an exemplary Laboratory Test Tube Handling Device in the locked position.
Figure 3:
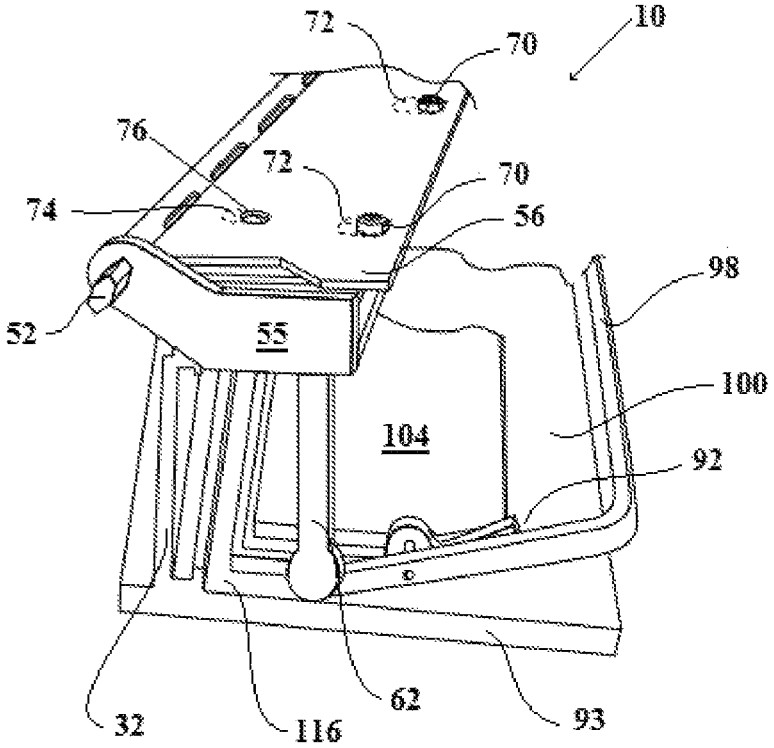
FIG. 3 presents an sectional view Perspective view of an exemplary Laboratory Test Tube Handling Device in the unlocked position.
Figure 4:
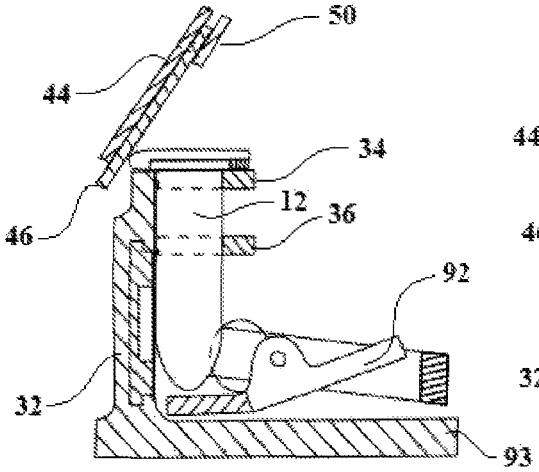
FIG. 4 presents a sectioned isometric view of the exemplary Laboratory Test Tube Handling Device in the open position.
Figure 5:
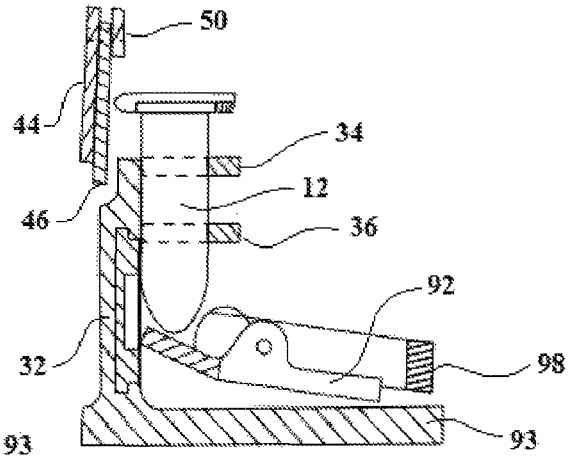
FIG. 5 presents a sectioned Isometric view of the exemplary Laboratory Test Tube Handling Device in the open position whereby the test tubes are being raised by lower device.
Figure 6:
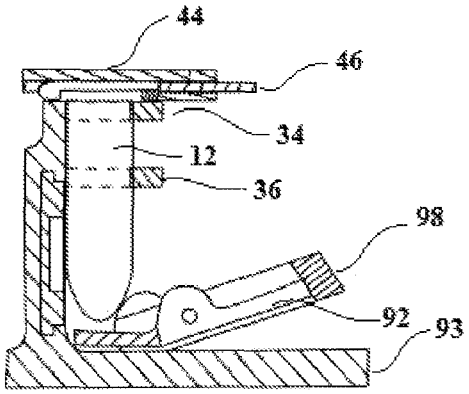
FIG. 6 presents a sectioned Isometric view of the exemplary Laboratory Test Tube Handling Device in the closed position.
Figure 7:
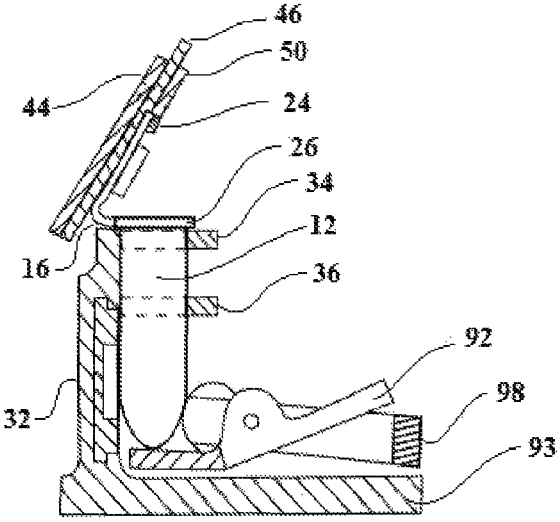
FIG. 7 presents a sectioned Isometric view of the exemplary Laboratory Test Tube Handling Device in the open position prior to the test tubes are being raised by lower device.

Further, a magnetic accessory 110 for magnetic separation of content within the test tubes 12 when desired may also be provided. In this respect, in one embodiment, an elongate lateral slot 112 may defined by a space 112 between the rear wall 30 and an upstanding flange 114 spaced forwardly of rear wall 32 on the base 30 as shown in FIG. 1 or may be defined by space 112 between the rear wall 30 and upstanding rails 116 as shown in FIGS. 2-3. The magnetic accessory 110 in a preferred embodiment comprises a strip of magnetic dots 112 or the like which is configured to align each magnetic dot 112 behind one of the plurality of test tubes 12 within the assembly 10.

As described above, the assembly 10 of the present invention provides a number of advantages, some of which have been described above and others of which are inherent in the invention. Also, modifications may be proposed to the apparatus 10 without departing from the teachings herein. Accordingly, the scope of the invention is only to be limited as necessitated by the accompanying claims.

As will be recognized by those of ordinary skill in the pertinent art, numerous modifications and substitutions can be made to the above-described embodiments of the present invention without departing from the scope of the invention. Accordingly, the preceding portion of this specification is to be taken in an illustrative, as opposed to a limiting sense.

An assembly for simultaneously opening a plurality of capped test tubes, the test tubes including caps configured to engage over an open end of each of said test tubes, each cap including a circumferential collar engaged about the open end of each of said test tubes and having a cover engaged to the collar by a living hinge at one circumferential position therealong and having a locking nub at an opposite circumferential position therealong which coacts with a slot in the collar for locking the cover to the collar, the assembly comprising a horizontal base from which a rear wall extends upwardly, a pair of vertically spaced apart test tube receiving and aligning shelves extending from the rear wall over said base and having aligned openings therein for aligned positioning of the test tubes vertically beneath a working pivotable top of the apparatus, the working pivotable top comprising a multilevel substantially planar element having a center support member and upon which are slidably mounted top and bottom planar members, the bottom planar member engaging the locking nub of each cap when in a first position thereof to simultaneously release and open each cover of the plurality of capped test tubes therebeneath and when in a second position thereof, allowing the pivotable top to pivot upwardly without releasing the caps.

The assembly of claim 1 wherein the top and bottom slidable planar members slide rearwardly and forwardly upon the center support member. The assembly of claim 1 wherein the covers of the test tubes are opened by the bottom member when the bottom member is rearwardly positioned. The assembly of claim 1 wherein the covers of the test tubes remain closed when the bottom member is in a forwardly position. The assembly of claim 1 wherein an accessory test tube lifting platen pivotably positioned beneath the test tubes is pivoted upwardly for ease in grasping of the test tubes.

The assembly of claim 1 wherein an accessory top pivoting rod with an upstanding finger at each rear end thereof is pivoted to raise the upstanding finger into engagement with and against a forwardly positioned end edge side flange of the assembly top to pivot same to a vertical position.

The assembly of claim 1 wherein an accessory magnetic strip is provided for magnetically separating contents within the test tubes. The assembly of claim 7 wherein a slot for the accessory magnetic strip is provided forward of and adjacent to the rear wall of the assembly.

The assembly of claim 7 wherein the magnetic accessory strip incorporates magnetic dots which align behind tubes located within the assembly. The assembly of claim 1 wherein a top one of the vertically aligned spaced apart shelves having openings therein also includes alignment shoulders on a top surface therein for aligning the hinges of the test tube caps toward a rear of the assembly. The assembly of claim 1 wherein the center support member includes a plurality of cutouts for accommodating covers of the test tube caps therein. The assembly of claim 1 wherein indicia are provided in the assembly top to indicate positioning of the bottom planar member. The assembly of claim 1 wherein the bottom planar member has cutouts therein which engage over the covers of the test tube caps and which when in the first position thereof releases the locking nub of each cover from engagement with a slot in the collar.

The assembly of claim 1 wherein the bottom planar member has cutouts therein which engage over the covers of the test tube caps and which when in the second position thereof do not release the locking nub of each cover from engagement with a slot in the collar, with each cover remaining engaged over the respective test tube. The assembly of claim 1 wherein each cutout in the bottom planar member includes an undercut forward edge which engages between the cover and the test tube to release the nub from engagement within the slot of the collar when the assembly top is in the first position thereof.

The assembly of claim 1 wherein a preferred plurality of test tubes to simultaneously be opened is more than one.

The assembly of claim 1 wherein the preferred plurality of test tubes to be simultaneously opened is 10. The assembly of claim 1 wherein the preferred plurality of test tubes to be simultaneously opened is more than 10.

The assembly of claim 1 wherein the top and bottom planar members of the assembly top are joined together via slots provided in the center support member. The assembly of claim 1 wherein the locking nubs are suitably engaged within the slots in the collar to keep same from opening until opened.

What is claimed is:

1. An assembly for simultaneously opening a plurality of capped test tubes, the test tubes including caps configured to engage over an open end of each of said test tubes, each cap including a circumferential collar engaged about the open end of each of said test tubes and having a cover engaged to the collar by a living hinge at one circumferential position therealong and having a locking nub at an opposite circumferential position therealong which coacts with a slot in the collar for locking the cover to the collar, the assembly comprising a horizontal base from which a rear wall extends upwardly, a pair of vertically spaced apart test tube receiving and aligning shelves extending from the rear wall over said base and having aligned openings therein for aligned positioning of the test tubes vertically beneath a working pivotable top of the apparatus, the working pivotable top comprising a multilevel substantially planar element having a center support member and upon which are slidably mounted top and bottom planar members, the bottom planar member engaging the locking nub of each cap when in a first position thereof to simultaneously release and open each cover of the plurality of capped test tubes therebeneath and when in a second position thereof, allowing the pivotable top to pivot upwardly without releasing the caps.

2. The assembly of claim 1 wherein the top and bottom slidable planar members slide rearwardly and forwardly upon the center support member.

3. The assembly of claim 1 wherein the covers of the test tubes are opened by the bottom member when the bottom member is rearwardly positioned.

4. The assembly of claim 1 wherein the covers of the test tubes remain closed when the bottom member is in a forwardly position.

5. The assembly of claim 1 wherein an accessory test tube lifting platen pivotably positioned beneath the test tubes is pivoted upwardly for ease in grasping of the test tubes.

6. The assembly of claim 1 wherein an accessory top pivoting rod with an upstanding finger at each rear end thereof is pivoted to raise the upstanding finger into engagement with and against a forwardly positioned end edge side flange of the assembly top to pivot same to a vertical position.

7. The assembly of claim 1 wherein an accessory magnetic strip is provided for magnetically separating contents within the test tubes.

8. The assembly of claim 7 wherein a slot for the accessory magnetic strip is provided forward of and adjacent to the rear wall of the assembly.

9. The assembly of claim 7 wherein the magnetic accessory strip incorporates magnetic dots which align behind test tubes located within the assembly.

10. The assembly of claim 1 wherein a top one of the vertically aligned spaced apart shelves having openings therein also includes alignment shoulders on a top surface therein for aligning the hinges of the test tube caps toward a rear of the assembly.

11. The assembly of claim 1 wherein the center support member includes a plurality of cutouts for accommodating covers of the test tube caps therein.

12. The assembly of claim 1 wherein indicia are provided in the assembly top to indicate positioning of the bottom planar member.

13. The assembly of claim 1 wherein the bottom planar member has cutouts therein which engage over the covers of the test tube caps and which when in the first position thereof release the locking nub of each cover from engagement with a slot in the collar.

14. The assembly of claim 1 wherein the bottom planar member has cutouts therein which engage over the covers of the test tube caps and which when in the second position thereof do not release the locking nub of each cover from engagement with a slot in the collar, with each cover remaining engaged over the respective test tube.

15. The assembly of claim 1 wherein each cutout in the bottom planar member includes an undercut forward edge which engages between the cover and the test tube to release the nub from engagement within the slot of the collar when the assembly top is in the first position thereof.

16. The assembly of claim 1 wherein a preferred plurality of test tubes to simultaneously be opened is more than one.

17. The assembly of claim 1 wherein the preferred plurality of test tubes to be simultaneously opened is 10.

18. The assembly of claim 1 wherein the preferred plurality of test tubes to be simultaneously opened is more than 10.

19. The assembly of claim 1 wherein the top and bottom planar members of the assembly top are joined together via slots provided in the center support member.

20. The assembly of claim 1 wherein the locking nubs are suitably engaged within the slots in the collar to keep same from opening until opened.

* * * * *